United States Patent [19]
Rottleb
[11] 4,317,548
[45] Mar. 2, 1982

[54] SPOOL FOR THREAD

[75] Inventor: Dieter Rottleb, Gutach, Fed. Rep. of Germany

[73] Assignee: Gutermann & Co., Aktiengesellschaft, Zurich, Switzerland

[21] Appl. No.: 172,224

[22] Filed: Jul. 25, 1980

Related U.S. Application Data

[63] Continuation of Ser. No. 48,583, Jun. 13, 1979, abandoned.

[30] Foreign Application Priority Data

Jul. 7, 1978 [GB] United Kingdom ..... 29239/78

[51] Int. Cl.[3] ..... B65H 75/14; B65H 75/28
[52] U.S. Cl. ..... 242/125.2
[58] Field of Search ..... 242/125.1, 125.2, 125

[56] References Cited

U.S. PATENT DOCUMENTS

| | | | |
|---|---|---|---|
| 1,443,533 | 1/1923 | Hall et al. | 242/125.2 |
| 2,501,515 | 3/1950 | Hood | 242/125.1 X |
| 2,678,012 | 5/1954 | Ayres | 242/125.1 X |
| 3,658,275 | 4/1972 | Lahmann | 242/125.1 |
| 4,027,831 | 6/1977 | Rottleb | 242/125.1 |
| 4,165,055 | 8/1979 | Dee | 242/125.2 |

FOREIGN PATENT DOCUMENTS

| | | | |
|---|---|---|---|
| 2647528 | 4/1978 | Fed. Rep. of Germany | 242/125.1 |
| 2647544 | 4/1978 | Fed. Rep. of Germany | 242/125.1 |

*Primary Examiner*—Stanley N. Gilreath
*Attorney, Agent, or Firm*—Cushman, Darby & Cushman

[57] ABSTRACT

The invention relates to moulded plastic spools for thread having a groove in which thread can be trapped. A spool 1 is provided for carrying thread windings on which is included a flexible flange 5 mounted at one end. A thread trapping member 8 is adapted to be fitted to such end of the spool so that a surface of the thread trapping member abuts against the surface 5*a* of the flexible flange to form a groove between the thread trapping member and the flexible flange. The groove can be opened on flexing of the flange for facilitating insertion of thread therein.

9 Claims, 4 Drawing Figures

Figure 3:
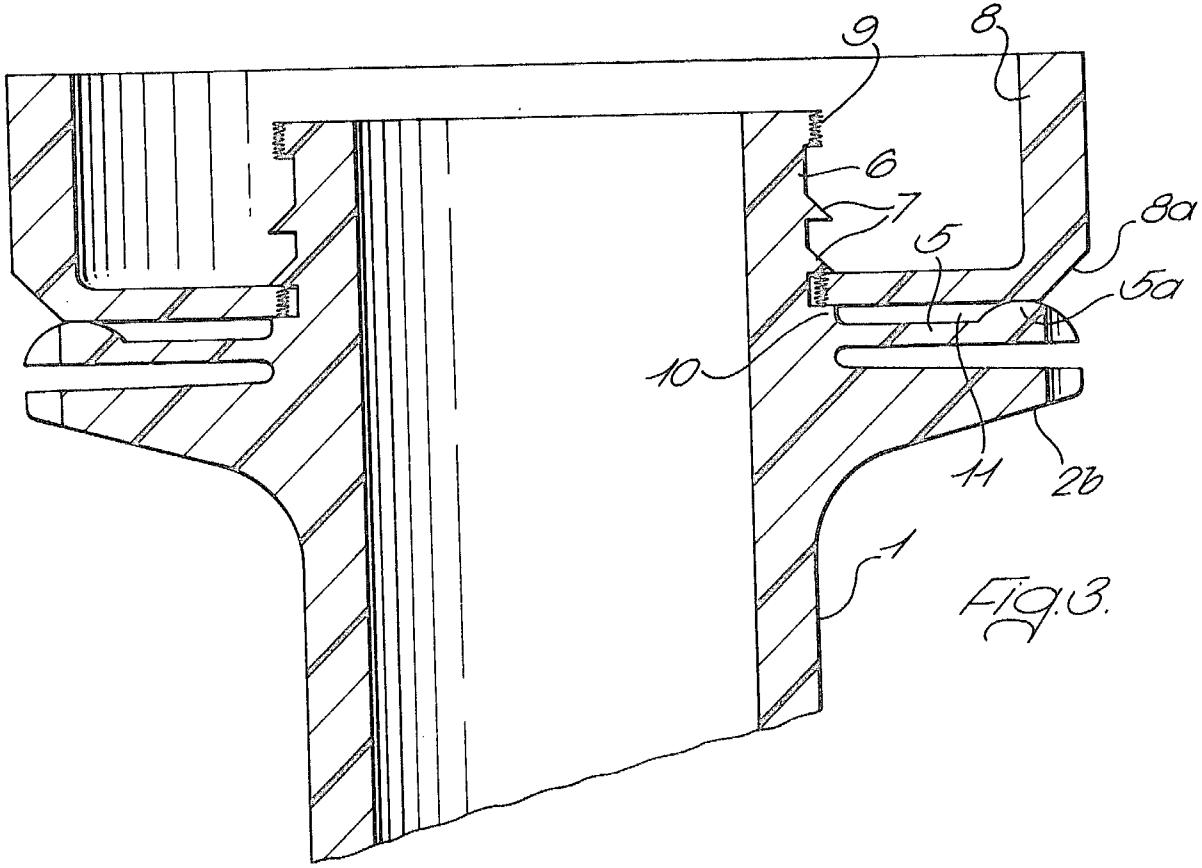

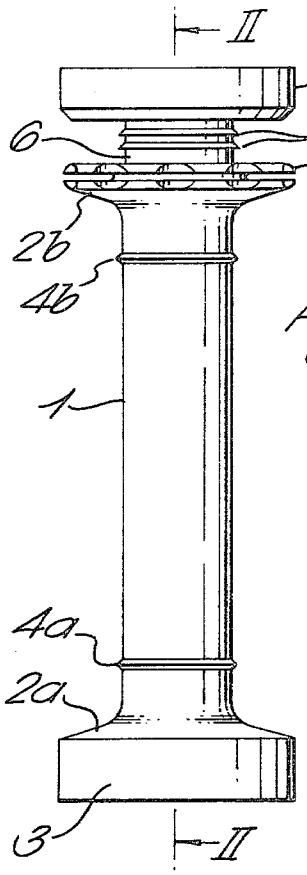
Fig. 1.
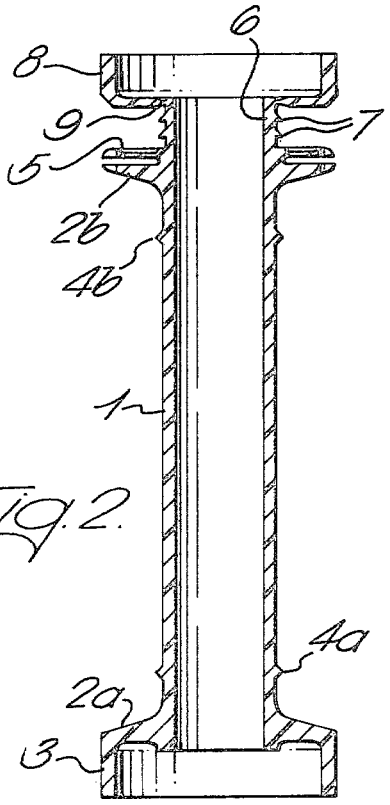
Fig. 2.
Fig. 4.
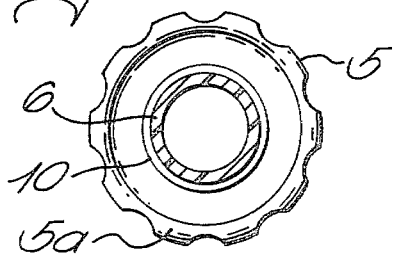

SPOOL FOR THREAD

This is a continuation of application Ser. No. 48,583, filed June 13, 1979, now abandoned.

The present invention relates to a plastics spool for sewing thread provided with an arrangement for trapping the thread end.

The difficulty of forming a groove in plastics spools which does not tend to chafe the thread has been solved by a plastics spool comprising two co-operating members which can be brought together to form a groove therebetween. Spools of this type comprise a thread trapping member which can be fitted to an end of a spool member comprising thread windings such that a surface of the thread trapping member abuts an end flange of the spool member forming a groove therebetween. Such spools are described in British Pat. Nos. 1474673 and 1247970.

A disadvantage of the above arrangement is that the two co-operating members may tend to separate and the groove widens, and hence the thread end is not tightly retained in the groove. If the two co-operating members are fitted too tightly together it is difficult to insert the thread end in the groove.

The present invention seeks to avoid the above difficulties and disadvantages by providing a plastics spool having an improved arrangement for trapping the thread end.

According to the present invention there is provided a plastics moulding for carrying thread comprising:

(a) a spool member for carrying thread windings, (b) a flexible flange mounted on one end of said spool member, (c) a thread trapping member adapted to be fitted to such end of the spool member so that a surface of the thread trapping member abuts against a surface of the flexible flange to form a groove for trapping thread, said grooove being openable on flexing of the flexible flange for facilitating insertion of thread therein.

In a preferred form of the invention, the flexible flange is in the form of a circular disc mounted around the circumference of the spool member.

In another preferred form of the invention, said end of the spool member is provided with a protuberance, said thread trapping member being in the form of a collar adapted to frictionally fit over said protuberance and abut with the flexible flange.

Preferably the thread trapping member is integrally moulded to the spool member and connected thereto by frangible bridging means so that it can be broken off and fitted to abut against the flexible flange. In this way, only a single moulding operation is necessary to manufacture the spool.

The preferred embodiments of the invention will now be described by way of illustration with reference to the accompanying drawings in which:

FIG. 1 is a side view of a spool of the invention, showing the thread trapping member in an integral moulding with the spool member, FIG. 2 is a cross-sectional view of FIG. 1 along the line II—II, FIG. 3 is an enlarged cross-sectional view of the thread end trapping arrangement in the use of the spool of FIG. 1 showing the thread trapping member broken from and attached to the spool member so that it abuts the flexible flange, FIG. 4 is a view of a preferred form of flexible flange shown in FIG. 1.

Referring to FIGS. 1 and 2 there is shown a spool having a cylindrical portion 1 for carrying thread. End flanges 2*a* and 2*b* are provided at the ends of the cylindrical portion 1 for retaining the thread windings. Flange 2*a* is provided with a depending skirt 3. Two rings 4*a* and 4*b* are provided on cylindrical portion 1, and act as winding aids to prevent the thread layer from spreading too much when the winding of the thread on the spool is initially started.

A flexible flange 5 is provided on the outside of flange 2*b* of the spool member and is moulded around a cylindrical protuberance 6 extending axially outwards from one end of the spool member. Protuberance 6 is provided with a plurality of ribs 7. A thread trapping member 8, in the form of a collar is integrally connected with the end of the protuberance 6, by frangible bridging means 9.

The spool is moulded as a unitary moulding with the thread trapping member 8, attached to the spool member by frangible bridging means 9 and the thread trapping member 8 is then broken off and fitted to co-operate with the flexible flange 5 to form the groove when it is desired to use the spool. FIG. 3 shows the thread trapping member 8 in its cooperating position with flexible flange 5.

Referring to FIG. 3, it will be seen that once the flangible bridging means has been broken by pushing thread trapping member 8 towards flexible flange 5, the thread trapping member 8 is pushed over ribs 7 of protuberance 6 to abut shoulder 10 radially inward of flexible flange 5. It will be seen that the shape of each rib 7 is such as to prevent the thread trapping member 8 from moving away from shoulder 10.

It will also be seen that once member 8 abuts against shoulder 10 it also abuts against projection 5*a* of flexible flange 5, thus forming a groove 11 between the flexible flange 5 and member 8 for trapping thread.

The member 8 has a tapered corner 8*a* and the projection 5*a* is rounded. Once the thread has been wound on the spool, the thread end can be readily trapped in groove 11 by passing it over flange 2*b* and forcibly inserting it into the gap formed between the projection 5*a* and tapered corner 8*a*, whereby the thread will flex the flange 5 and thus, the projection 5*a*, away from member 8. The permanent pressure of projection of 5*a* on member 8 also prevents the thread from coming out of the groove 11.

During the factory operation of producing sewing thread packages, the member 6 can be fitted to co-operate with the flexible flange 5 and used to secure the thread end before the spool is sold to the consumer. Alternatively the thread end can be secured by other means initially, and the consumer can be left to effect the positioning of the member 8.

Referring to FIG. 4, there is shown a preferred form of flexible flange 5. The flange is of generally circular shape, but its perimeter has a number of indentations therein. It has been found that these indentations assist the user in inserting the thread and into the groove 11. A corresponding number of indentations may also be provided on the flange 2*b* in corresponding circumferential positions.

In order to prevent the spool from rotating too fast when mounted on the spindle of sewing machines, elements (not shown) may be provided within the spool body which frictionally engage with said spindle thus providing a braking effect on the rotation of the spool.

Whilst the thread trapping member has been illustrated as being in the form of a collar it will be appreciated that other arrangements may be used, provided a surface is provided which abuts against the flexible flange. The collar could be provided with a cylindrical portion which telescopes within the said cylindrical portion 1 of the spool member.

Further alternative arrangements to those specifically described will also be apparent to those skilled in the art.

I claim:

1. A plastics spool comprising: a cylindrical body for carrying thread windings, axially spaced apart end flanges for retaining the thread windings on the body between the end flanges, an annular flange disposed adjacent and axially spaced from one of said end flanges on the side thereof opposite the other end flange, said annular flange being flexible in axial directions, a collar disposed adjacent said flexible flange on the side thereof away from said one end flange, said collar being an annular member fitted over the end of said spool and held in position by engagement between an annular shoulder on said spool adjacent said flexible flange and an annular rib on said spool, said collar and said flexible flange being slightly spaced from each other at their radially inward portions to form an annular groove and said flexible flange having a circumferential portion of greater thickness than the remainder of said flexible flange, said portion extending axially toward and abutting said collar at a location radially outwardly of said groove whereby a thread pressed against the area of abutment will cause the flexible flange to flex axially away from said collar and permit the thread to enter said groove.

2. A plastics moulding for carrying thread comprising (a) a spool member for carrying thread windings, (b) a thread winding retaining flange mounted on one end of the spool, (c) a flexible flange integral with said one end of said spool member at a fixed location axially outward from said thread winding retaining flange such that there is an axial space between said flexible flange and said retaining flange, (d) a thread trapping member adapted to be fitted to said one end of the spool member so that a surface of the thread trapping member abuts against a surface of the flexible flange to form a groove for trapping thread, said groove being openable on flexing of the flexible flange toward said retaining flange for facilitating insertion of thread therein.

3. A plastics moulding according to claim 2, wherein said flexible flange is in the form of a substantially circular disc mounted around the circumference of the spool member.

4. A plastics moulding according to claim 3, wherein an annular projection extends from the peripheral portion of the disc surface against which the thread trapping member abuts.

5. A plastics moulding according to claims 3 or 4, wherein said circular disc has at least one indentation formed on its perimeter to facilitate insertion of thread into the groove.

6. A plastics moulding according to claim 5, wherein said thread winding retaining flange comprises a circular flange adjacent said circular disc on the side of said circular disc away from said thread trapping member, said circular flange having one or more indentations thereon, corresponding in number and circumferential position to those on the circular disc.

7. A plastics moulding according to any one of claims 2, 3 or 4 wherein said spool member is provided with a radial protuberance at said one end, said thread trapping member being in the form of a collar adapted to frictionally fit over said protuberance and abut with the flexible flange.

8. A plastics moulding according to any one of claims 2, 3 or 4, further comprising a second thread winding retaining flange mounted on the opposite end of said spool member to said one end.

9. A plastics moulding according to any one of claims 2, 3 or 4 moulded as a unitary moulding, said thread trapping member being connected to said spool member by frangible bridging means.

* * * * *